US007553804B2

(12) United States Patent
Liu et al.

(10) Patent No.: US 7,553,804 B2
(45) Date of Patent: Jun. 30, 2009

(54) AQUEOUS LIQUID CRYSTAL DISPLAY CLEANING AGENT COMPOUNDS AND THEIR FABRICATION METHODS

(75) Inventors: Dong Liu, Shenzhen (CN); Xuegang Chen, Shenzhen (CN); Junqing Dong, Shenzhen (CN); Qing Gong, Shenzhen (CN); Zhiql He, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 0 days.

(21) Appl. No.: 11/646,050

(22) Filed: Dec. 26, 2006

(65) Prior Publication Data

US 2007/0149433 A1 Jun. 28, 2007

(30) Foreign Application Priority Data

Dec. 26, 2005 (CN) ..... 2005 1 0132751

(51) Int. Cl.
*C11D 1/83* (2006.01)
*C11D 3/36* (2006.01)

(52) U.S. Cl. ..... 510/243; 510/163; 510/180; 510/351; 510/352; 510/356; 510/357; 510/413; 510/414; 510/421; 510/422; 510/423; 510/425; 510/426; 510/427; 510/428; 510/431; 510/436

(58) Field of Classification Search ..... 510/163, 510/180, 243, 351, 352, 356, 357, 413, 414, 510/421, 423, 422, 425, 426, 427, 428, 431, 510/436

See application file for complete search history.

(56) References Cited

U.S. PATENT DOCUMENTS 6,686,322 B1 2/2004 Nohara et al.
2003/0106572 A1* 6/2003 Nishiki et al. ..... 134/26
2005/0201967 A1* 9/2005 Albrecht et al. ..... 424/70.13
2006/0264344 A1* 11/2006 Goldberg et al. ..... 510/130

FOREIGN PATENT DOCUMENTS

CN 01114910 10/2001
CN 03122204 10/2003

OTHER PUBLICATIONS

ZhiQi Liang, Practical Manual cleaning technology, 2005, p. 376, Chemical Industry Press, Beijing, China.
Cheng Liu, WangFu Zhang, ChangMing Cheng, Surfactant Handbook, 1996, p. 63, Chemical Industry Press, Beijing, China.

* cited by examiner

*Primary Examiner*—Charles I Boyer
(74) *Attorney, Agent, or Firm*—Venture Pacific Law, PC

(57) ABSTRACT

The present invention discloses aqueous LCD cleaning agent compounds and their fabrication methods. Said cleaning agent compounds comprise of double fatty acid polyethylene glycol ester, fatty alcohol polyoxyethylene ether, polyethylene(3) glycol alkyl ether tri(alkyl ethers)amine sulfate and/or polyethylene(3) glycol enyl ether tri(alkyl ethers)amine sulfate, alkyl benzenesulfonic acid, lecithins and water. In particular, the weight of the ingredients in the compounds as a weight percentage of the weight of the compounds is: double fatty acid polyethylene glycol ester (10-50 wt %), fatty alcohol polyoxyethylene ether (5-60 wt %), polyethylene(3) glycol alkyl ether tri(alkyl ethers)amine sulfate and/or polyethylene(3) glycol enyl ether tri(alkyl ethers)amine sulfate (5-20 wt %), alkyl benzenesulfonic acid (1-15 wt %), lecithins (1-10 wt %), water (5-50 wt %). Embodiments of the aqueous LCD cleaning agent compounds of the present invention can effectively remove both the crystal liquid materials in the gaps between the two glass substrates and foreign contaminate particles attached on the surfaces of the glass substrates. Moreover, the LCD cleaning agent compounds have the characteristics of low toxicity, environmental friendliness, low flammability and high cleaning capabilities for various crystal liquid materials.

20 Claims, No Drawings

AQUEOUS LIQUID CRYSTAL DISPLAY CLEANING AGENT COMPOUNDS AND THEIR FABRICATION METHODS

CROSS REFERENCE

This application claims priority from a Chinese patent application entitled "Aqueous Liquid Crystal Display Cleaning Agent Compounds and Their Fabrication Methods" filed on Dec. 26, 2005, having a Chinese Application No. 200510132751.X. This Chinese application is incorporated here by reference.

FIELD OF INVENTION

This invention relates to liquid crystal display cleaning agent compounds and their fabrication methods, and in particular, aqueous liquid crystal display cleaning agent compounds and their fabrication methods.

BACKGROUND

Liquid crystal displays (LCDs) have been widely used as various displays because of their characteristics of low power consumption, excellent picture quality and light weight. For example, LCDs have been developed for computer monitors, televisions and mobile phones.

In the LCD manufacturing process, two glass substrates having a 10 μm gap between them are bonded to one another by a sealant. Then the liquid crystal is injected into the space between the two substrates. There are electrodes inside the two grass substrates. The electrodes are made of transparent conductive membranes and control the displays of characters and images. Applying controlling electrical signals to the membranes can control the displays of the characters and images.

During the manufacturing process of the LCDs, the sides where the two glass substrates are bonded will inevitably have small gaps with a few μm in the width. When injecting the liquid crystal material into the space between the two glass substrates, the liquid crystal material can invade the gaps by the capillary tube phenomenon. Since the contaminants in the atmosphere can dissolve in the crystal liquid material in the gaps and the gaps are very close to the positions where the controlling electrical signals are applied to the transparent electrodes, as a result, there can be insulation deterioration problems. Therefore, the crystal liquid material in the gaps needs to be cleaned.

Since the gaps are very narrow and are normally fewer than 10 um in width, the cleaning agents need to have highly effective cleaning capabilities in order to remove the liquid crystal material in the gaps. Among the most commonly used cleaning agents, organic solvents having halogen, such as fluohydrocarbon, 1,1,2-trichloroethane, 1,1,2-trichloroethene, perchloroethene and dichloromethane work relatively well. However, there are significant restrictions on the use of organic solvents having halogen since the restrictions on the use of the organic solvents are an important part in the world environmental protection policies.

With the demands for alternative cleaning agents, various new cleaning agents that can substitute said organic solvents having halogen have been developed, in particular, hydrocarbon solvents or mixed compound of both hydrocarbon solvent and polyglycol ether. For example, Patent JP10-25495 disclosed an effective cleaning agent for the LCDs. Said cleaning agent comprises of 5-95 wt % saturated hydrocarbon and/or saturated cycle having boiling points between 60° C. and 280° C. (For example, n-Decane or Cyclododecatriene-1,5,9), and 5-95 wt % ethylene glycol having the chemical formula of R1-(O—$C_nH_{2n}$)$_m$—O—R2 (in particular, R1 and R2 are H, alkyl oracyl-, the total number of carbon atoms in R1 and R2 is 1 to 20, n is 2 or 3; m is an integer between 1 and 3). (For example, vinyl ethylene glycol dimethyl ether). However, said cleaning agent has relative weak cleaning capabilities and high flammability.

Moreover, in the manufacturing process of the LCDs, a mother glass is cut into small glass substrates and lots of powders are generated in the cutting process. These powders can attach to the surfaces of the electrode terminal so as to hamper the later sealing process. Moreover, the surface foreign contaminants such as glass powders normally attach to the surfaces of the LCDs by inter-molecular force. But they can also strongly attach to the surfaces of the LCDs using liquid crystal material as a binding agent. As a result, the cleaning agent needs to have much higher cleaning capabilities to remove the surface contaminants. For the most commonly used cleaning agents for the glass powders, the patents JP 5-271699, JP 7-305093 and JP 2001-181699 disclosed cleaning agents that are alkaline cleaning agents. However, the alkaline cleaning agents not only cause surfaces damages for the LCDs, but also cannot effectively remove the glass powder attached to the surfaces of the LCDs.

With the recent development in the high-density technology of the LCDs, the gap between the two glass substrates is getting narrower. Moreover, with the increasing demands for better throughput and higher passing rate for the production, the cleaning agents need to be able to clean the LCDs effectively in a very short time. The cleaning agents need effectively clean not only the liquid crystal material in the gaps near the bonding of the two glass substrates, but also the foreign contaminants on the surfaces of the electrode terminal. Furthermore, currently used STN liquid crystal material comprises of aromatics with —CN as typical substituents; while the TFT liquid crystal material comprises of aromatics with —CN as typical substituents. Since these two liquid crystal materials have substantial differences in the molecular structures and physical properties, there are demands for versatile LCD cleaning agent compounds suitable for diverse molecular structures and physical properties.

Due to the limitations of the prior art, it is therefore desirable to have novel LCD cleaning agents that can effectively remove not only the liquid crystal material in the gaps between the sides of the two glass substrates, but also the foreign contaminants attached to the surfaces of the LCDs.

SUMMARY OF INVENTION

An object of this invention is to provide LCD cleaning agent compounds that effectively remove both the crystal liquid materials in the gaps between the two glass substrates and foreign contaminate particles attached on the surfaces of the glass substrates.

Another object of this invention is to provide the fabrication methods for said LCD cleaning agent compounds.

Briefly, the present invention relates to new compositions for LCD cleaning agent compounds. Said compounds are comprised of double fatty acid polyethylene glycol ester, fatty alcohol polyoxyethylene ether, polyethylene(3) glycol alkyl ether tri(alkyl ethers)amine sulfate and/or polyethylene(3) glycol enyl ether tri(alkyl ethers)amine sulfate, alkyl benzenesulfonic acid, lecithins and water. In particular, the weight of the ingredients in the compounds as a weight percentage of the weight of the compound is: double fatty acid polyethylene glycol ester (10-50 wt %), fatty alcohol polyoxyethylene ether (5-60 wt %), polyethylene(3) glycol alkyl ether tri(alkyl ethers)amine sulfate and/or polyethylene(3) glycol enyl ether tri(alkyl ethers)amine sulfate (5-20 wt %), alkyl benzenesulfonic acid (1-15 wt %), lecithins (1-10wt %), water (5-50 wt %).

An advantage of this invention is that the LCD cleaning agent compounds have the characteristics of low toxicity, environmental friendliness, low flammability and high cleaning capabilities for various crystal liquid materials.

DETAILED DESCRIPTION OF THE PREFERRED EMBODIMENTS

Embodiments of cleaning agent compounds for the LCDs of the present invention may be comprised of double fatty acid polyethylene glycol ester, fatty alcohol polyoxyethylene ether, polyethylene(3) glycol alkyl ether tri(alkyl ethers) amine sulfate and/or polyethylene(3) glycol enyl ether tri (alkyl ethers)amine sulfate, alkyl benzenesulfonic acid, lecithins and water. In particular, the weight of the ingredients in the compound as a weight percentage of the compound is: double fatty acid polyethylene glycol ester (10-50 wt %), fatty alcohol polyoxyethylene ether (5-60 wt %), polyethylene(3) glycol alkyl ether tri(alkyl ethers)amine sulfate and/or polyethylene(3) glycol enyl ether tri(alkyl ethers)amine sulfate (5-20 wt %), alkyl benzenesulfonic acid (1-15 wt %), lecithins(1-10 wt %), water (5-50 wt %).

The methods of fabricating the embodiments of LCD cleaning agent compounds include mixing double fatty acid polyethylene glycol ester, fatty alcohol polyoxyethylene ether, polyethylene(3) glycol alkyl ether tri(alkyl ethers) amine sulfate and/or polyethylene(3) glycol enyl ether tri (alkyl ethers)amine sulfate, alkyl benzenesulfonic acid, lecithins and water thoroughly. In particular, the weight of the ingredients in the compounds as a weight percentage of the compounds is: double fatty acid polyethylene glycol ester (10-50 wt %), fatty alcohol polyoxyethylene ether (5-60 wt %), polyethylene(3) glycol alkyl ether tri(alkyl ethers)amine sulfate and/or polyethylene(3) glycol enyl ether tri(alkyl ethers)amine sulfate (5-20 wt %), alkyl benzenesulfonic acid (1-15 wt %), lecithins(1-10 wt %), water (5-50 wt %).

Said double fatty acid polyethylene glycol ester has cleaning and viscosity increasing properties and its chemical formula is shown here:

$$R_1COO—(CH_2—CH_2—O—CH_2—CH_2—O)_n—OC—R_2$$

In the formula, R1 and R2 are either alkyl or ethenyl having 3 to 15 carbon atoms, preferably 5 to 13 carbon atoms. Said R1 and R2 can be different or identical, preferably identical. Said R1 and R2 can be selected from, but not limited to, the following: pentyl-, hexyl-, hepty-, octyl-, nonyl-, decyl-, undecyl-, dodecane-, tridecyl-, pentenyl-, Hexenyl-, heptenyl-, octenyl-, nonenyl-, decenyl-, undecenyl-, dodecenyl-; n is an integer between 3 and 15, preferably between 5 and 12. Said alkylcan be either straight-chain hydrocarbon or branched-chain hydrocarbon. Moreover, the structure of said alkyl and the position of double bond in said ethenyl do not affect the functions of this chemical in the present invention.

Said double fatty acid polyethylene glycol ester can be preferably selected from at least one from the following: polyoxyethylene(10)glycol bi(Lauric acid), polyoxyethylene( 10)glycol bi(undecanedicarboxylic acid), polyoxyethylene( 10)glycol bi(Undecenoic acid).

The weight of said double fatty acid polyethylene glycol ester is preferably between 10 wt % and 40 wt % of the total weight of the LCD cleaning agent compound.

Said ether fatty alcohol polyoxyethylene ether has cleaning and emulsification properties. It is chemical formula is shown below:

$$RO—(CH_2—CH_2—O)_N—H$$

In the formula, said R can be either alkyl or ethenyl having 8 to 14 carbon atoms, preferably 9 to 12 carbon atoms. Said R can be one from the following: nonyl-, decyl-, undecyl-, dodecane-, nonenyl-, decenyl-, undecenyl-, dodecenyl-; n is an integer between 5 and 15, preferably between 6 and 12. Said alkyl can be either straight-chain hydrocarbon or branched-chain hydrocarbon. Moreover, the structure of said alkyl and the position of double bond of said ethenyl do not affect the functions of this chemical in the present invention.

Said fatty alcohol polyoxyethylene ether is preferably at least one from the following: polyoxyethylene (6) nonyl ether, polyoxyethylene (8) decyl ether, polyoxyethylene (6) dodecane ether, polyoxyethylene (10) dodecane ether, polyoxyethylene (6) undecenyl ether, polyoxyethylene (11) dodecenyl ether.

The weight of said fatty alcohol polyoxyethylene ether is preferably between 30 wt % and 50 wt % of the total weight of the LCD cleaning agent compound.

Said polyethylene(3) glycol alkyl ether tri(alkyl ethers) amine sulfate and/or polyethylene(3) glycol enyl ether tri (alkyl ethers)amine sulfate have diffusion and volume increasing properties. It is chemical formula is shown below:

$$RO—(CH_2—CH_2—O)_3—SO_3HNR'_3$$

In the formula, said R is either alkyl or ethenyl having 8 to 14 carbon atoms, preferably 10 to 13 carbon atoms. Said R can be one of the following: decyl-, undecyl-, dodecane-, tridecyl-, decenyl-, undecenyl- and dodecenyl-. Said R' can be alkyl alcohol having 1 to 4 carbon atoms, preferably 1 to 3 carbon atoms. Said R' can be one of the following: methanol, ethanol or propanol. Said alkylcan be straight-chain hydrocarbon or branched-chain hydrocarbon. Moreover, the structure of said alkyl and the position of the double bond in said ethenyl do not affect the functions of this chemical in the present invention.

Said polyethylene(3) glycol alkyl ether tri(alkyl ethers) amine sulfate and/or polyethylene(3) glycol enyl ether tri (alkyl ethers) amine sulfate is preferably at least one from the following: polyethylene(3) glycol undecyl ether tri(ethanol) amine sulfate, polyethylene(3) glycol dodecane ether tri (ethanol)amine sulfate, polyethylene(3) glycol tridecyl ether tri(ethanol)amine sulfate, polyethylene(3) glycol dodecane ether tri(methanol)amine sulfate, polyethylene(3) glycol dodecane ether tri(propanol)amine sulfate, polyethylene(3) glycol undecenyl ether tri(ethanol)amine sulfate, polyethylene(3) glycol dodecenyl ether tri(methanol)amine sulfate, polyethylene(3) glycol dodecenyl ether tri(propanol)amine sulfate.

The weight of said polyethylene(3) glycol alkyl ether tri (alkyl ethers)amine sulfate and/or polyethylene(3) glycol enyl ether tri(alkyl ethers)amine sulfate is preferably between 5-15 wt % of the total weight of the LCD cleaning agent compound.

Said alkyl benzenesulfonic acid has cleaning and permeation properties. It is chemical formula is shown below:

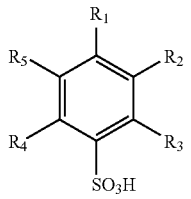

In the above formula, said R1-R6 can be identical or different. R1-R6 can be either hydrogen or alkyl. Said alkyl has 6-15 carbon atoms, preferably 8-13.

Said alkyl benzenesulfonic acid is preferably selected at least one from the following: octyl-benzenesulfonic acid, nonyl—benzenesulfonic acid, decyl—benzenesulfonic acid, undecyl-benzenesulfonic acid, dodecylbenzenesulfonic acid, or tridecyl-benzenesulfonic acid. The position of the alkyl in said alkyl benzenesulfonic acid can be o-, p- or m- to the sulfonic acid, preferably o-. Moreover, the position and the structure of said alkyl do not affect the functions of this chemical in the present invention.

The weight of said alkyl benzenesulfonic acid is preferably between 5 wt % and 15 wt % of the total weight of the LCD cleaning agent compound.

Said lecithins have anti-oxidation and diffusion properties. The weight of said lecithins is preferably between 2 wt % and 5 wt % of the total weight of the LCD cleaning agent compound.

The weight of said water is preferably between 10 wt % and 20 wt % of the total weight of the LCD cleaning agent compound.

The present invention provides methods of fabrication for the LCD cleaning agent compound. The methods include mixing double fatty acid polyethylene glycol ester, fatty alcohol polyoxyethylene ether, polyethylene(3) glycol alkyl ether tri(alkyl ethers)amine sulfate and/or polyethylene(3) glycol enyl ether tri(alkyl ethers)amine sulfate, alkyl benzenesulfonic acid, lecithins and water together. The weight of each ingredient in the compound as the percentage weight of the total weight of the compound is: double fatty acid polyethylene glycol ester (preferably 10-40 wt %), fatty alcohol ether fatty alcohol polyoxyethylene ether (preferably 30-50 wt %), polyethylene(3) glycol alkyl ether tri(alkyl ethers)amine sulfate and/or polyethylene(3) glycol enyl ether tri(alkyl ethers) amine sulfate (preferably 5-15 wt %), alkyl benzenesulfonic acid (preferably 5-15 wt %), lecithins (preferably 2-5 wt %) and water (preferably 10-20 wt %). The mixing of the ingredients is preferably performed at room temperature and by stirring.

The present invention also provides methods of cleaning for LCDs. The methods comprise of the following steps:

soaking the liquid crystal cells in the cleaning agent compound solution with said cells being completely submerged in said solution;

soaking temperature is between 30° C. and 80° C., the soaking time is between 5 and 45 minutes. Preferably, the soaking is performed along with ultrasound wave, the soaking temperature is between 45° C. and 65° C. and the soaking time is between 10 and 35 minutes;

removing said cells out of the cleaning agent compound solution;

washing said cells with 0.1-5 wt % alkaline solution such as potassium hydroxide or sodium hydroxide;

washing said cells with distilled water; and drying said cells and the drying conditions and methods are well known to ordinary person skilled in the art.

The following embodiments further describe this invention.

Embodiment 1

This embodiment describes the cleaning of liquid crystal cells with a cleaning agent compound that is an embodiment of the present invention.

The fabrication of the cleaning agent compound comprises of the following steps:

mixing polyoxyethylene(10)glycol bi(Lauric acid), polyoxyethylene (6) n-dodecane ether, polyoxyethylene (10) n-dodecane ether, polyethylene(3) glycol n-dodecane ether tri(ethanol)amine sulfate, p-octyl-benzenesulfonic acid, lecithins and deionized water at a weight ratio of 25:40:5:10:8:2:10;

mixing the ingredients above thoroughly to obtain the cleaning agent compound solution A1;

heating said cleaning agent compound solution to 50° C.;

soaking 50 liquid crystal cells (BYD Inc., Model Number 280A) in the cleaning agent compound solution;

shaking said solution and washing said cells with ultrasound wave for 20 minutes;

taking the liquid crystal cells out of the cleaning agent solution;

washing said cells with 1 wt % potassium hydroxide solution and distilled water respectively; and drying said cells at 100° C. for two hours.

Embodiment 2

This embodiment describes the cleaning of liquid crystal cells with a cleaning agent compound that is an embodiment of the present invention.

The fabrication of the cleaning agent compound comprises of the following steps:

mixing polyoxyethylene(10)glycol bi(Lauric acid), polyoxyethylene (8) n-decyl ether, polyoxyethylene (6) n-nonyl ether, 11-polyoxyethylene (11) dodecenyl ether, polyethylene(3) glycol n-tridecyl ether tri(ethanol)amine sulfate, o-dodecylbenzenesulfonic acid, p-octyl-benzenesulfonic acid, lecithins and deionized water at a weight ratio of 15:30:5:5:10:5:5:5:20;

mixing the ingredients thoroughly to obtain the cleaning agent compound solution A2;

heating said cleaning agent compound to 50° C.;

soaking 50 liquid crystal cells (BYD Inc., Model Number 280A) into the cleaning agent compound solution;

shaking said solution and washing said cells with ultrasound wave for 10 minutes;

taking the liquid crystal cells out of the cleaning agent solution;

washing said cells with 1 wt % potassium hydroxide solution and distilled water respectively; and drying said cells at 100° C. for two hours.

Embodiment 3

This embodiment describes the cleaning of liquid crystal cells with a cleaning agent compound that is an embodiment of the present invention.

The fabrication of the cleaning agent compound comprises of the following steps:

mixing polyoxyethylene(10)glycol bi(Lauric acid), polyoxyethylene (8) n-decyl ether, polyoxyethylene (6) n-nonyl ether, 11-polyoxyethylene (11) dodecenyl ether, polyethylene(3) glycol n-tridecyl ether tri(ethanol)amine sulfate, o-dodecylbenzenesulfonic acid, p-octyl-benzenesulfonic acid, lecithins and deionized water at a weight ratio of 15:30:5:5:10:5:5:5:20;

mixing the ingredients thoroughly to obtain the cleaning agent compound solution A3;

heating said cleaning agent compound solution to 55° C.;

soaking 50 liquid crystal cells (BYD Inc., Model Number 280A) in the cleaning agent compound solution;

shaking said solution and washing said cells with ultrasound wave for 15 minutes;

taking the liquid crystal cells out of the cleaning agent solution;

washing said cells with 1 wt % potassium hydroxide solution and distilled water respectively; and drying said cells at 100° C. for two hours.

Embodiment 4

This embodiment describes the cleaning of liquid crystal cells with a cleaning agent compound that is an embodiment of the present invention.

The fabrication of the cleaning agent compound comprises of the following steps:

mixing polyoxyethylene(10)glycol bi(Lauric acid), polyoxyethylene(10)glycol bi(n-tridecyl acid), polyoxyethylene (6) n-dodecane ether, polyethylene(3) glycol n-dodecane ether tri(methanol)amine sulfate, o-undecyl-benzenesulfonic acid, lecithins and deionized water at a weight ratio of 25:10:40:5:5:5:10;

mixing the ingredients thoroughly to obtain the cleaning agent compound solution A4;

heating said cleaning agent compound solution to 50° C.;

soaking 50 liquid crystal cells (BYD Inc., Model Number 280A) in the cleaning agent compound solution;

shaking said solution and washing said cells with ultrasound wave for 25 minutes;

taking the liquid crystal cells out of the cleaning agent solution;

washing said cells with 1 wt % potassium hydroxide solution and distilled water respectively; and drying said cells at 100° C. for two hours.

Embodiment 5

This embodiment describes the cleaning of liquid crystal cells with a cleaning agent compound that is an embodiment of the present invention.

The fabrication of the cleaning agent compound comprises of the following steps:

mixing polyoxyethylene(10)glycol bi(n-undecyl acid), polyoxyethylene (6) n-dodecane ether, polyethylene(3) glycol n-dodecane ether tri(propanol)amine sulfate, o-octyl-benzenesulfonic acid, lecithins and deionized water at a weight ratio of 15:35:15:15:5:15;

mixing the ingredients thoroughly to obtain the cleaning agent compound A5;

heating said cleaning agent compound solution to 45° C.;

soaking 50 liquid crystal cells (BYD Inc., Model Number 280A) in the cleaning agent compound solution;

shaking said solution and washing said cells with ultrasound wave for 10 minutes;

taking the liquid crystal cells out of the cleaning agent solution;

washing said cells with 1 wt % potassium hydroxide solution and distilled water respectively; and drying said cells at 100° C. for two hours.

Embodiment 6

This embodiment describes the cleaning of liquid crystal cells with a cleaning agent compound that is an embodiment of the present invention.

The fabrication of the cleaning agent compound comprises of the following steps:

mixing polyoxyethylene(10)glycol bi(Lauric acid), polyoxyethylene (8) n-decyl ether, 10-polyethylene(3) glycol dodecenyl ether tri(propanol)amine sulfate, polyethylene(3) glycol dodecenyl ether tri(ethanol)amine sulfate, o-undecyl-benzenesulfonic acid, lecithins and deionized water at a weight ratio of 38:30:5:2:7:3:15;

mixing the ingredients thoroughly by stirring to obtain the cleaning agent compound solution A6;

heating said cleaning agent compound to 50° C.;

soaking 50 liquid crystal cells (BYD Inc., Model Number 280A) in the cleaning agent compound solution;

shaking said solution and washing said cells with ultrasound wave for 10 minutes;

taking the liquid crystal cells out of the cleaning agent solution;

washing said cells with 1 wt % potassium hydroxide solution and distilled water respectively; and drying said cells at 100° C. for two hours.

Embodiment 7

This embodiment describes the cleaning of liquid crystal cells with a cleaning agent compound that is an embodiment of the present invention.

The fabrication of the cleaning agent compound comprises of the following steps:

mixing polyoxyethylene(10)glycol bi(undecenyl acid), 9-polyoxyethylene (6) undecenyl ether, polyethylene(3) glycol n-dodecane ether tri(ethanol)amine sulfate, o-octyl-benzenesulfonic acid, lecithins, and deionized water at a weight ratio of 12:50:12:8:4:14;

mixing the ingredients thoroughly by stirring to obtain the cleaning agent compound solution A7;

heating said cleaning agent compound to 60° C.;

soaking 50 liquid crystal cells (BYD, Inc., Model Number 280A) in said cleaning agent compound solution A7;

shaking said solution and washing said cells with ultrasound wave for 10 minutes;

taking the liquid crystal cells out of the cleaning agent solution;

washing said cells with 1 wt % potassium hydroxide solution and distilled water respectively; and drying said cells at 100° C. for two hours.

COMPARISON EXAMPLE 1

This comparison example describes the cleaning of the liquid crystal cells using traditional cleaning agent compounds.

The liquid crystal cells are cleaned under the identical methods as in Embodiment 1. The only difference is that a cleaning agent with model number CFC113 is used. The cleaning agent is labeled as B1 here.

Embodiments 8-14

These embodiments describe the cleaning rate test for the liquid crystal cells cleaned with the cleaning agents A1-A7 fabricated in the Embodiments 1-7, respectively.

Said cleaning rate is the passing rate for the cleaned liquid crystal cells. The cleaning rate test is performed as described here. After cleaning, the glass substrates of the cleaned liquid crystal cells are observed under microscope. If there are neither crystal material leftovers nor foreign contaminants on the surfaces of the liquid crystal box, then the liquid crystal box is a qualified product. The cleaning rate can be calculated according to the following formula: cleaning rate=(The number of qualified products/The total number of the liquid crystal cells cleaned)×100%. The results are shown in Table 1.

COMPARISON EXAMPLE 2

The cleaning rate test is performed as described in Embodiments 8-14. The only difference is that the cleaning agent in Comparison Example 1 is used. The results are shown in Table 1.

TABLE 1

| Embodiment No. | Cleaning Agent No. | Cleaning Rate |
|---|---|---|
| Embodiment 8 | A1 | 98% |
| Embodiment 9 | A2 | 94% |
| Embodiment 10 | A3 | 95% |
| Embodiment 11 | A4 | 95% |
| Embodiment 12 | A5 | 94% |
| Embodiment 13 | A6 | 96% |
| Embodiment 14 | A7 | 93% |
| Comparison Example 2 | B1 | 90% |

Table 1 shows that the aqueous cleaning agent compounds that are embodiments of the present invention have distinctly improved cleaning properties over the traditional LCD cleaning agent compounds. As shown in Table 1, the cleaning rate for the liquid crystal cells cleaned with the traditional cleaning agent with model number CFC113 is only about 90% while the cleaning rate for the cells cleaned with the cleaning agent A1 that is an embodiment of the present invention is 98%.

While the present invention has been described with reference to certain preferred embodiments, it is to be understood that the present invention is not limited to such specific embodiments. Rather, it is the inventor's contention that the invention be understood and construed in its broadest meaning as reflected by the following claims. Thus, these claims are to be understood as incorporating not only the preferred embodiments described herein but also all those other and further alterations and modifications as would be apparent to those of ordinary skilled in the art.

We claim:

1. An aqueous cleaning agent compound, comprising:

double fatty acid polyethylene glycol ester;

fatty alcohol polyoxyethylene ether;

polyethylene(3) glycol alkyl ether tri(alkyl ethers)amine sulfate and/or polyethylene(3) glycol alkenyl ether tri (alkyl ethers)amine sulfate;

alkyl benzenesulfonic acid;

lecithins; and water.

2. The cleaning agent compound of claim 1 wherein the weight of said double fatty acid polyethylene glycol ester is between 10-50 wt % of the weight of said cleaning agent compound;

the weight of said fatty alcohol polyoxyethylene ether is between 5-60 wt % of the weight of said cleaning agent compound;

the weight of said polyethylene(3) glycol alkyl ether tri (alkyl ethers)amine sulfate and/or polyethylene(3) glycol alkenyl ether tri(alkyl ethers)amine sulfate is between 5-20 wt % of the weight of said cleaning agent compound;

the weight of said alkyl benzenesulfonic acid is between 1-15 wt % of the weight of said cleaning agent compound;

the weight of said lecithins is between 1-10 wt % of the weight of said cleaning agent compound; and the weight of said water is between 5-50 wt % of the weight of said cleaning agent compound.

3. The cleaning agent compound of claim 1 wherein the weight of said double fatty acid polyethylene glycol ester is between 10-40 wt % of the weight of said cleaning agent compound;

the weight of said fatty alcohol polyoxyethylene ether is between 30-50 wt % of the weight of said cleaning agent compound;

the weight of said polyethylene(3) glycol alkyl ether tri (alkyl ethers)amine sulfate and/or polyethylene(3) glycol alkenyl ether tri(alkyl ethers)amine sulfate is between 5-15 wt % of the weight of said cleaning agent compound;

the weight of said alkyl benzenesulfonic acid is between 5-15 wt % of the weight of said cleaning agent compound;

the weight of said lecithins is between 2-5 wt % of the weight of said cleaning agent compound; and the weight of said water is between 10-20 wt % of the weight of said cleaning agent compound.

4. The cleaning agent compound of claim 1 wherein said double fatty acid polyethylene glycol ester has the following formula:

$$R_1COO—(CH_2—CH_2—O—CH_2—CH_2—O)_n—OC—R_2$$

wherein said $R_1$, $R_2$ are identical or different alkyl or alkenyl having 3 to 15 carbon atoms and n is an integer from 3 to 15.

5. The cleaning agent compound of claim 4 wherein said $R_1$ and $R_2$ are identical;

said $R_1$ and $R_2$ is selected from the group consisting of pentyl-, hexyl-, hepty-, octyl-, nonyl-, decyl-, undecyl-, dodecane-, tridecyl-, pentenyl-, Hexenyl-, heptenyl-, octenyl-, nonenyl-, decenyl-, undecenyl-, dodecenyl-dodecenyl-; and n is an integer from 5 to 12.

6. The cleaning agent compound of claim 4 wherein said double fatty acid polyethylene glycol ester is selected from the group consisting of polyoxyethylene(10)glycol bi(Lauric acid), polyoxyethylene(10)glycol bi(undecanedicarboxylic acid), polyoxyethylene(10)glycol bi(Undecenoic acid).

7. The cleaning agent compound of claim 1 wherein said fatty alcohol polyoxyethylene ether has the following formula:

$$RO—(CH_2—CH_2—O)_n—H$$

wherein R is alkyl or ethenyl having 8 to 14 carbon atoms and n is an integer between 5 and 15.

8. The cleaning agent compound of claim 7 wherein said R is selected from the group consisting of nonyl-, decyl-, undecyl-, dodecane-, nonenyl-, decenyl-, undecenyl-, dodecenyl-; and n is an integer between 6 and 12.

9. The cleaning agent compound of claim 7 wherein said fatty alcohol polyoxyethylene ether is selected from the group consisting of polyoxyethylene (6) nonyl ether, polyoxyethylene (8) decyl ether, polyoxyethylene (6) dodecane ether, polyoxyethylene (10) dodecane ether, polyoxyethylene (6) undecenyl ether, polyoxyethylene (11) dodecenyl ether.

10. The cleaning agent compound of claim 1 wherein said polyethylene(3) glycol alkyl ether tri(alkyl ethers) amine sulfate and/or polyethylene(3) glycol alkenyl ether tri(alkyl ethers)amine sulfate have the following formula:

$$RO—(CH_2—CH_2—O)_3—SO_3HNR'_3$$

wherein R is alkyl or ethenyl having 8 to 14 carbon atoms; and

R' is alkyl alcohol having 1 to 4 carbon atoms.

11. The cleaning agent compound of claim 10 wherein said R is selected from the group consisting of decyl-, undecyl-, dodecane-, tridecyl-, decenyl-, undecenyl-, dodecenyl-; and said R' is selected from the group consisting of methanol, ethanol, propanol.

12. The cleaning agent compound of claim 10 wherein said polyethylene(3) glycol alkyl ether tri(alkyl ethers) amine sulfate and/or polyethylene(3) glycol alkenyl ether tri(alkyl ethers)amine sulfate is selected from the group consisting of polyethylene(3) glycol undecyl ether tri(ethanol)amine sulfate, polyethylene(3) glycol dodecane ether tri(ethanol)amine sulfate, polyethylene (3) glycol tridecyl ether tri(ethanol)amine sulfatepolyethylene(3) glycol dodecane ether tri(ethanol)amine sulfate, polyethylene(3) glycol dodecane ether tri (methanol)amine sulfate, polyethylene(3) glycol dodecane ether tri(propanol)amine sulfate, polyethylene(3) glycol undecenyl ether tri(ethanol)amine sulfate, polyethylene(3) glycol dodecenyl ether tri(methanol)amine sulfate, polyethylene(3) glycol dodecenyl ether tri(propanol)amine sulfate.

13. The cleaning agent compound of claim 1 wherein said alkyl benzenesulfonic acid has the following formula:

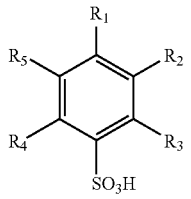

wherein $R_1$, $R_2$, $R_3$, $R_4$, $R_5$, $R_6$ can be different or identical alkyl having 6 to 15 hydrogen atoms or carbon atoms.

14. The cleaning agent compound of claim 13 wherein said alkyl benzenesulfonic acid is selected from the group consisting of octyl-benzenesulfonic acid, nonyl-benzenesulfonic acid, decyl-benzenesulfonic acid, undecyl-benzenesulfonic acid, dodecylbenzenesulfonic acid, tridecyl-benzenesulfonic acid.

15. A method for fabricating said cleaning agent compound of claim 1 wherein said double fatty acid polyethylene glycol ester, fatty alcohol polyoxyethylene ether, polyethylene(3) glycol alkyl ether tri(alkyl ethers)amine sulfate and/or polyethylene (3) glycol alkenyl ether tri(alkyl ethers)amine sulfate, alkyl benzenesulfonic acid, lecithins and water are mixed together;

the weight of said double fatty acid polyethylene glycol ester is between 10-50 wt % of the weight of said cleaning agent compound;

the weight of said fatty alcohol polyoxyethylene ether is between 5-60 wt % of the weight of said cleaning agent compound;

the weight of said polyethylene(3) glycol alkyl ether tri (alkyl ethers)amine sulfate and/or polyethylene(3) glycol alkenyl ether tri(alkyl ethers)amine sulfate is between 5-20 wt % of the weight of said cleaning agent compound;

the weight of said alkyl benzenesulfonic acid is between 1-15 wt % of the weight of said cleaning agent compound;

the weight of said lecithins is between 1-10 wt % of the weight of said cleaning agent compound; and the weight of said water is between 5-50 wt % of the weight of said cleaning agent compound.

16. The method for fabricating the cleaning agent compound of claim 15 wherein the weight of said double fatty acid polyethylene glycol ester is between 10-40 wt % of the weight of said cleaning agent compound;

the weight of said fatty alcohol polyoxyethylene ether is between 30-50 wt % of the weight of said cleaning agent compound;

the weight of said polyethylene(3) glycol alkyl ether tri (alkyl ethers)amine sulfate and/or polyethylene(3) glycol alkenyl ether tri(alkyl ethers)amine sulfate is between 5-15 wt % of the weight of said cleaning agent compound;

the weight of said alkyl benzenesulfonic acid is between 5-15 wt % of the weight of said cleaning agent compound;

the weight of said lecithins is between 2-5 wt % of the weight of said cleaning agent compound; and the weight of said water is between 10-20 wt % of the weight of said cleaning agent compound.

17. The method for fabricating the cleaning agent compound of claim 15 wherein said double fatty acid polyethylene glycol ester is selected from the group consisting of polyoxyethylene(10)glycol bi(Lauric acid), polyoxyethylene(10)glycol bi(undecanedicarboxylic acid), polyoxyethylene(10)glycol bi(Undecenoic acid).

18. The method for fabricating the cleaning agent compound of claim 15 wherein said fatty alcohol polyoxyethylene ether is selected from the group consisting of polyoxyethylene (6) nonyl ether, polyoxyethylene (8) decyl ether, polyoxyethylene (6) dodecane ether, polyoxyethylene (10) dodecane ether, polyoxyethylene (6) undecenyl ether, polyoxyethylene (11) dodecenyl ether.

19. The method for fabricating the cleaning agent compound of claim 15 wherein said polyethylene(3) glycol alkyl ether tri(alkyl ethers) amine sulfate and/or polyethylene(3) glycol alkenyl ether tri(alkyl ethers)amine sulfate is selected form the group consisting of polyethylene(3) glycol undecyl ether tri(ethanol)amine sulfate, polyethylene(3) glycol dodecane ether tri(ethanol)amine sulfate, polyethylene (3) glycol tridecyl ether tri(ethanol)amine sulfate, polyethylene(3) glycol dodecane ether tri(methanol)amine sulfate, polyethylene(3) glycol dodecane ether tri(propanol)amine sulfate, polyethylene(3) glycol undecenyl ether tri(ethanol)amine sulfate, polyethylene(3) glycol dodecenyl ether tri(methanol)amine sulfate, polyethylene(3) glycol dodecenyl ether tri(propanol)amine sulfate.

20. The method for fabricating the cleaning agent compound of claim 15 wherein said alkyl benzenesulfonic acid is selected from the group consisting of octyl-benzenesulfonic acid, nonylbenzene sulfonic acid, acid decylbenzene sulfonic acid, undecylbenzenesulfonic acid, dodecylbenzenesulfonic acid and, tridecyl-benzenesulfonic acid.

* * * * *